United States Patent [19]

Lack

[11] 3,986,376

[45] Oct. 19, 1976

[54] LOCK

[76] Inventor: Sigo Lack, 98-33 64th Ave., Forest Hills, N.Y. 11374

[22] Filed: Apr. 1, 1975

[21] Appl. No.: 563,996

[52] U.S. Cl. ..... 70/364 A; 70/376; 70/419; 70/DIG. 49

[51] Int. Cl.[2] ..... E05B 27/00

[58] Field of Search ..... 70/364, 376, 377, 378, 70/419, 421, 432, 439, 441, DIG. 30, DIG. 49; 200/42 R, 42 A, 44

[56] References Cited

UNITED STATES PATENTS

| | | | |
|---|---|---|---|
| 772,112 | 10/1904 | Oleschak | 70/364 R |
| 1,685,154 | 9/1928 | Edwards | 70/364 A |
| 2,057,301 | 10/1936 | Golokow et al. | 70/364 A X |
| 2,061,354 | 11/1936 | Federholzner | 70/419 X |
| 2,690,665 | 10/1954 | Oroquieta | 70/364 R |
| 2,754,673 | 7/1956 | Schachinger | 70/421 X |
| 3,216,230 | 11/1965 | Falk | 70/421 |
| 3,596,014 | 7/1971 | Erez | 200/44 |

FOREIGN PATENTS OR APPLICATIONS

| | | | |
|---|---|---|---|
| 1,079,067 | 8/1967 | United Kingdom | 70/419 |

*Primary Examiner*—Lawrence J. Staab

[57] ABSTRACT

A pin and tumbler type lock in which a slide element is disposed at that end of the cylinder opposite the end from which the key is inserted, the slide element cooperating with a pin in the barrel and having a projecting portion diametrically opposite to the pin with which it cooperates which, in the locked condition, engages in an opening of the barrel. The slide element has a configuration for cooperation with the leading end of a key so that insertion of the correct key causes disengagement of that portion of the slide extending into the opening in the barrel and additionally brings abutting portions of the slide element and the cooperating pin to a shear line between the cylinder and the barrel to free the lock. Additionally, at least one pin in the lock has an electrically conductive extension adapted, when the pin with which it is associated is raised beyond the shear line to complete a circuit to an alarm device. Additionally, a tumbler of the lock is of reduced cross-section in the region where it abuts a corresponding pin to render picking the lock more difficult.

4 Claims, 3 Drawing Figures

LOCK

This invention is concerned with locks of the pin and tumbler kind, i.e. with locks of the kind having a cylinder rotatably disposed within a barrel, the cylinder having a key slot along which are disposed a plurality of tumblers which cooperate with a corresponding plurality of pins disposed in the barrel. A common technique for picking such locks is to take in one hand a blade-like element, insert it into the key slot and turn the cylinder as far as possible. Thereafter, a picking instrument is taken in the other hand and is inserted into the key slot and the tumblers manipulated until their upper edges abut that part of the edge of an opening in the barrel within which the pin is received, which is caused by the turning of the cylinder relatively to the barrel, to be moved into the path of the tumblers. In this way the picker brings each of the tumblers and pins into the position in which the abutting surfaces of those pins and tumblers are disposed on the shear line between the cylinder and barrel and thereafter he is able to turn the cylinder to withdraw a bolt associated with the lock.

The present invention seeks to avoid or render more difficult, picking in this way.

According to one aspect of the present invention, at that end of the cylinder remote from the end from which the key is inserted there is provided a radially slidable element which at one diametrical end cooperates with a pin disposed in the barrel and at its other end has an integral projection which in the locked condition of the device is pressed into a corresponding opening in the adjacent part of the barrel. The projection of the slide element and the opening in the barrel are preferably dimensioned to preclude relative rotation of the barrel and cylinder until such time as the projection is disengaged from the opening.

The slide element has a configuration adapted for engagement by the end of the key first inserted into the key slot so that when the correct key is inserted the slide is shifted to allow the lock to be released. Most desirably, the configuration is arranged to have surfaces which cooperate with each edge of a key inserted into the key slot.

Additionally, according to this invention, at least one of the tumblers of the cylinder is provided in the region where it abuts the corresponding pin in the cylinder with a reduced section so that it is impossible upon attempting to pick the lock in the manner discussed hereinabove for the picker to be able to feel the edge of the opening in the barrel within which the pin associated with that tumbler, is disposed.

Additionally, according to this invention, there is provided on one or more of the pins in the barrel, an electrically conductive extension element or stem which, when the edge of the pin cooperating with the associated tumbler is at the shear line, is spaced very slightly from an electrically conductive element. In this way, if the pin in a picking operation is raised slightly above the shear line, as is almost certain to occur, the extension of the pin will contact the electrically conductive element above it so that a circuit is completed which may include an alarm element.

An embodiment of the invention is illustrated, schematically, in the accompanying drawings, in which.

Figure 1:
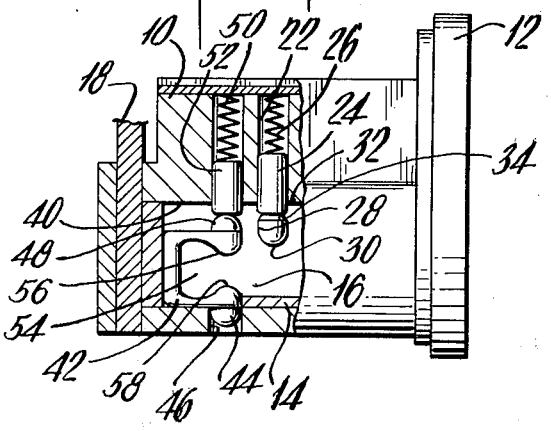
FIG. 1 is a part side, part cross-sectional view of a lock embodying this invention.
Figure 2:
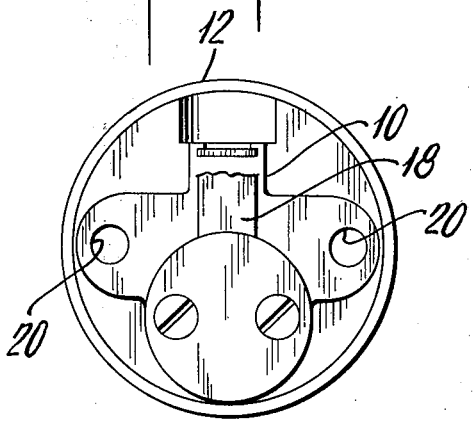
FIG. 2 is an end view of the lock of FIG. 1.

Referring now to FIG. 1, the lock comprises a barrel portion 10 with a mounting plate 12. Within a bore 14 of the barrel 10 there is rotatably mounted a cylinder 16 which carries in conventional fashion a lever 18 which is effective upon rotation of the cylinder to withdraw a bolt or other locking element.

The lock has conventional mounting holes 20 by which it may be secured to a closure member.

Figure 3:
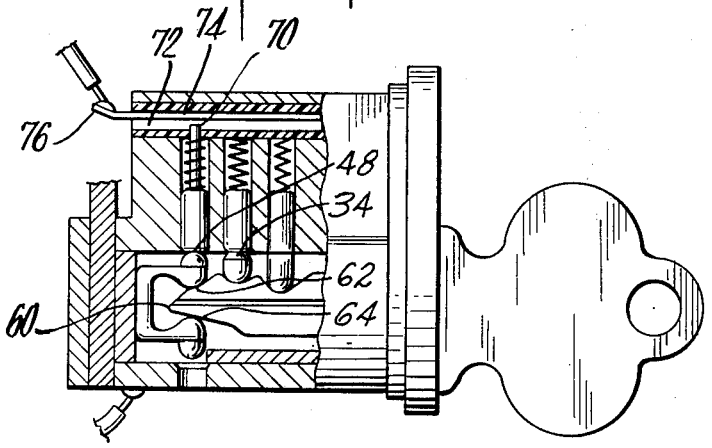
FIG. 3 is a view similar to that of FIG. 1 of a slightly modified version of the invention in which the lock is shown with a key inserted therein to raise the tumblers and associated pins to the shear line to free the cylinder for rotation in the barrel.

The barrel has a plurality of cylindrical passages 22, only one of which is visible in FIG. 1 and FIG. 3 and within which are disposed pins 24 which are loaded by coil springs 26 to be biased radially inwardly with respect to the cylinder 16. As is conventional, the cylinder is provided with a corresponding number of radial bores 28, again of which only one is visible in the drawings and within those passages 28 are disposed tumblers 30 which project, into a key slot.

To this point, the lock is largely conventional and the insertion of a correctly cut key would be effective to raise the plane at which the pins and tumblers abut to the shear line 32 between the cylinder and barrel so that the cylinder would be freed for rotation within the barrel to turn the lever 18.

It is to be noted that the pin 30, visible in FIGS. 1 and 3, has a portion 34 adjacent the corresponding pin which is of reduced diameter, i.e. is of lesser diameter than is the remainder of the tumbler and the adjacent pin so that the surface of the tumbler abutting the pin is of lesser area than is the pin surface with which it abuts.

As is well known, the cylinder of a lock in the locked condition can be turned a few degrees and this characteristic of this type of lock has been utilized by lock picks who would insert a turning instrument into the key slot and turn the cylinder slightly so that the passages 22 and bores 28 would be slightly out of line. The picker would then insert a picking instrument and would raise the tumblers until such time as the edge of the tumblers would abut the edge of the passage 22 in the cylinder and at this point, of course, the abutting surfaces of the tumblers and pins would be disposed on the shear line so that the cylinder would be freed for rotation to unlock the closure. By the simple expedient of reducing the section of at least one, but not all, of the tumblers, it will be appreciated that this process is rendered very much more difficult since, of course the tumbler of reduced thickness would not abut the edge of passage 22 until such time as it had been raised above the shear line.

At the end of the cylinder remote from that end from which the key is inserted, there is formed a radial slideway, generally indicated at 40, and disposed within that slideway to be rotatable with the cylinder is a slide element 42. The slide element has at one radial end a projection 44 which in the locked condition is received in an opening 46 formed in the barrel. The projection 44 and opening 46 are close fitting to inhibit turning of the cylinder within the barrel without first withdrawing projection 44. At the other radial end of the slide is a further projection 48 which has, as will be described hereinafter, the role of a tumbler.

Formed in the cylinder adjacent projection 48 is a passage 50 and that passage has a spring loaded pin element 52 disposed in it and cooperating with projections 48.

On that side of the slide element facing the key slot entrance there is formed a recess, generally indicated at 54, which defines surfaces 56 and 58 which cooperate with the lead end 60 of the key indicated in FIG. 3 and in particular cooperates with surfaces 62 ad 64 cut in opposite edges of the key.

It is to be appreciated that the surfaces 62 and 64 of the key must be cut with accuracy so that the lead end of the key will enter into the recess 54 and bring the surface of projection 48 which abuts pin 52 to the shear line and, of course, withdraw a projection 44 from the opening 46 in the barrel.

With this requirement for the careful cutting of both sides of the key, the use by an authorized person of a plurality of different master keys to determine which one would open the lock is rendered very much more difficult as, of course, is the picking of the lock.

To present a further obstacle to tampering with the lock, any one or more of the pins of the lock, including that operated by the slide element, may be provided with an electrically conducting stem element 70 which projects upwardly from the pin through the convolutions of the spring associated with that pin and into space 72 in insulating member 74. Disposed in the space 72 is a strip 76 of an electrically conductive material. It will be appreciated that strip 76 is insulated from the remainder of the barrel or body of the lock by insulator 74. It is also, of course, to be appreciated that the stem 70 is in electrical contact with the barrel.

By connecting the strip 76 into an alarm circuit and completing the circuit through the barrel of the lock, when the stem 70 makes contact with the strip the circuit will be closed and the alarm activated. It is to be understood that the alarm may be of any form.

From a consideration of FIG. 3, it will be clear that the spacing between the uppermost tip of the stem 70 and the strip 76 is, when the lower surface of the pin is at the shear line, very small. Thus, a person attempting to pick the lock has only to lift the pin slightly above the shear line to activate the alarm. Of course, the stem 70 may be associated with any or all of the tumblers and is an arrangement which could be utilized with locks not including, for example, the slide element 42 or the tumblers of reduced section. The same is true for that characteristic of the present invention which consists in having the pin 30 of reduced section, i.e. it may be utilized in a lock not including the slide element 42.

What is claimed is:

1. A lock comprising a barrel, a rotatable cylinder disposed in the barrel, a plurality of tumbler members disposed along a key slot of the cylinder and cooperating with a corresponding plurality of pin elements in the barrel to free the cylinder for rotation upon the insertion of a correctly coded key into said key slot, a U-shaped slide element mounted upon the cylinder for rotation therewith at an end thereof remote from that end from which a key is inserted, said slide element being mounted for sliding movement radially of the cylinder, a pin member disposed in the barrel adjacent the slide element, a portion of said slide element cooperating with said pin member, an opening in said barrel diametrically opposite to said pin member, a further portion of said slide element being disposed in said opening in a locked condition of the lock, a recess in said slide element defined by the arms and bight of said U-shape for cooperation with an end region of a key, said recess opening from the slide element in a direction facing the entry of the key slot for receiving a key inserted through said key slot, said recess passing through said slide element in a direction normal to the axis of the barrel and having opposite surfaces which cooperate with opposite surfaces of a correctly coded key, whereby upon insertion of the correctly coded key fully into the key slot, abutting portions of said pin member and slide element are brought to a shear line between said barrel and cylinder and said further portion of said slide element is withdrawn from said opening to free the cylinder for rotation within said barrel.

2. A lock as claimed in claim 1 wherein said tumbler elements have a contacting surface abutting a contacting surface of a corresponding pin element and wherein the contacting surface of at least one but not all of the tumbler elements is of lesser area than is the contacting surface of a pin element with which it abuts.

3. A lock as claimed in claim 1 wherein at least one of said pin elements includes an electrically conductive stem portion in electrical contact with said barrel and an elongated electrically conductive element is disposed in said barrel in an orientation substantially parallel to the axis of the barrel and electrically insulated therefrom, said stem, when said abutting surfaces are disposed at said shear line being slightly spaced from said electrically conductive element and when said abutting surfaces of said pin element is moved to a barrel side of said shear line, making contact with said electrically conductive element.

4. A lock as claimed in claim 2 wherein at least one of said pin elements includes an electrically conductive stem portion in electrical contact with said barrel and an electrically conductive element is disposed in said barrel and electrically insulated therefrom, said pin element having a surface abutting a corresponding one of said tumbler elements, said stem portion, when said surface of said pin element is disposed at the shear line being slightly spaced from said electrically conductive element and, when said surface of said pin element is moved to a barrel-side of said shear line making contact with said electrically conductive element.

* * * * *